United States Patent [19]

Hogberg

[11] Patent Number: 5,047,787

[45] Date of Patent: Sep. 10, 1991

[54] COUPLING CANCELLATION FOR ANTENNA ARRAYS

[75] Inventor: Shawn W. Hogberg, Chandler, Ariz.

[73] Assignee: Motorola, Inc., Schaumburg, Ill.

[21] Appl. No.: 345,319

[22] Filed: May 1, 1989

[51] Int. Cl.[5] ..... H01Q 1/52

[52] U.S. Cl. ..... 343/841; 343/705; 343/708; 343/767; 343/782; 343/872

[58] Field of Search ..... 343/705, 708, 767, 771, 343/782, 783, 841, 851, 872; 455/50, 63, 283

[56] References Cited

U.S. PATENT DOCUMENTS

| | | | |
|---|---|---|---|
| 2,947,987 | 8/1960 | Dodington | 343/841 |
| 3,277,488 | 10/1966 | Hoffman | 343/778 |
| 4,328,502 | 5/1982 | Scharp | 343/771 |
| 4,748,449 | 5/1988 | Landers, Jr. et al. | 343/705 |

*Primary Examiner*—Bernarr E. Gregory
*Attorney, Agent, or Firm*—Frank J. Bogacz

[57] ABSTRACT

An arrangement for providing RF coupling cancellation between an array of antennas of a missile is shown. The present invention includes positioning a dielectric material across a portion of the axis of the waveguide antennas of a missile. The dielectric material induces further coupling which is equal to and opposite in phase to coupling normally present between the receiving and transmitting antennas of an array. The two couplings are approximately 180 degrees out of phase and cancel each other. As a result, a high degree of isolation is obtained between antennas of an array. This enables the missile to detect targets with a high degree precision. Further, a radome of QFELT® material may be applied over the dielectric material to prevent the dielectric material from ablation during high velocity flight.

22 Claims, 2 Drawing Sheets

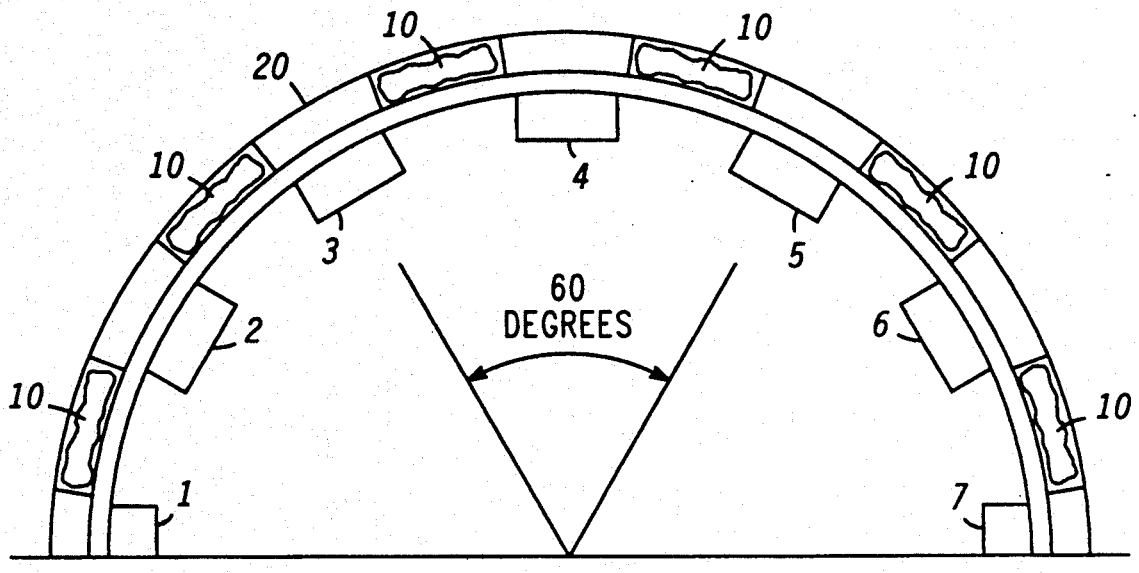
FIG. 1
-PRIOR ART-
FIG. 2
-PRIOR ART-
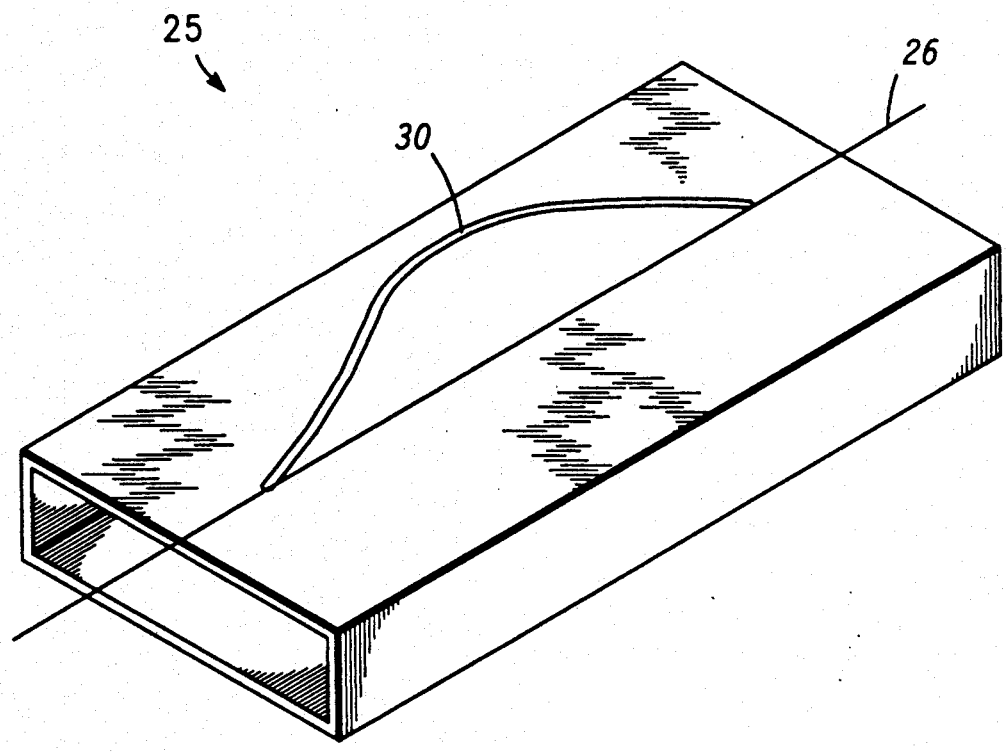

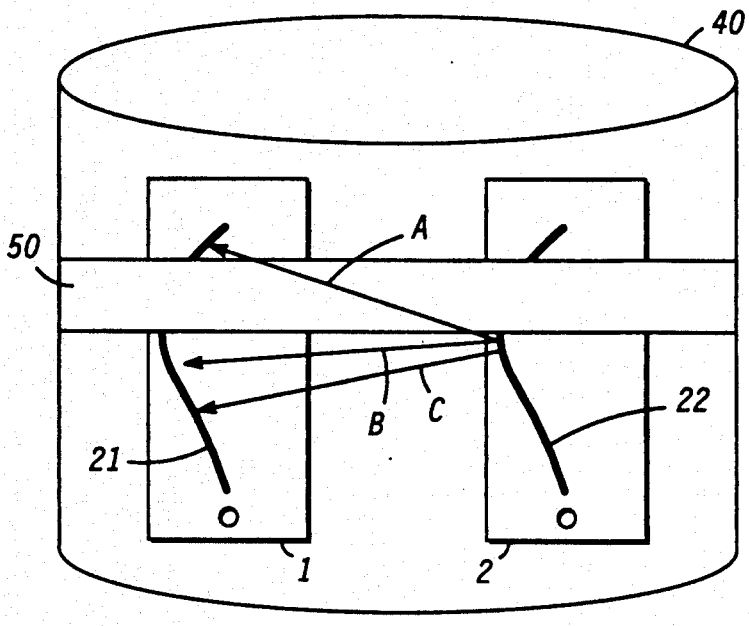
FIG. 3
FIG. 4
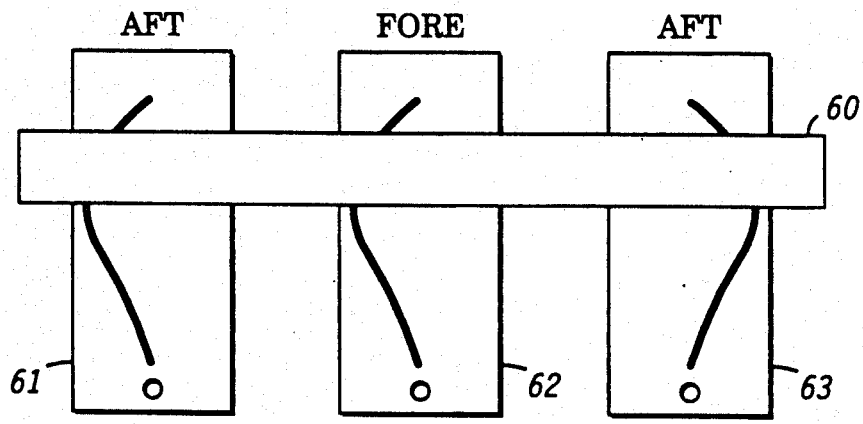
FIG 5
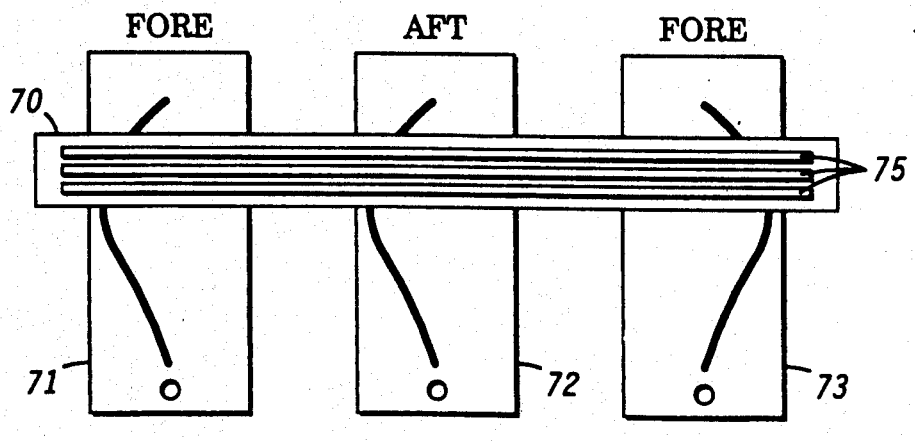

COUPLING CANCELLATION FOR ANTENNA ARRAYS

BACKGROUND OF THE INVENTION

This invention generally pertains to mutual coupling cancellation of cylindrical antenna arrays and more particularly to minimizing or cancelling mutual coupling between closely spaced, continuous-slot waveguides without the use of RF absorber material.

Generally, missiles employ microwave antenna arrays for guidance and detonation purposes. These antennas are generally placed at regularly spaced intervals about the circumference of the shroud of a missile. The antennas and shroud of the missile are then covered by a radome. This array of antennas projects a conical beam about the missile. This conical antenna beam detects the target regardless of the angle of approach of the target with respect to the missile.

In present day missiles, multiple antenna systems are employed. These multiple antenna systems project beams in different directions. For example, these directions may include the fore and aft directions. Typical long, continuous-slot waveguide antennas are depicted in U.S. Pat. No. 4,328,502, issued on May 4, 1982, to G. Scharp. These antennas are rectangular waveguides with semi-circular slot antennas cut through one surface of the waveguide.

As previous mentioned, these waveguide antennas are mounted about the periphery of the shroud of a missile. Each beam, fore or aft, is made up of a number of these waveguide antennas to provide total coverage around the missile for signal reception . These antennas are oriented so that the length of the slot of the antenna is along the length axis of the missile.

To achieve multiple beam of coverage with respect to the missile, the waveguide antennas are staggered about the periphery of the missile. That is, the placement of the antennas is about the periphery of the missile. These antennas are alternating aft and fore beam antennas. A common placement of antennas is approximately 60 degrees between antennas included in each one of the beams. Therefore, there are typically six antennas for each beam placed about the periphery of the missile for each antenna beam (fore or aft). Therefore, in a typical fore/aft antenna configuration, there would be twelve antennas regularly spaced about the periphery of the missile.

Mutual coupling between the transmit and receive antennas is a result of surface wave energy from the transmit antenna. The mutual coupling inhibits target detection by the missile.

One solution to this problem is the use of RF absorbing ablating apparatus placed within the radome of the missile and between each of the waveguide antennas. This RF absorbing material would eliminate a portion of the coupling between adjacent antennas. However, with the use of RF absorbing material sufficient coupling is obtained to prevent efficient signal detection by the missile. In addition, the RF absorber weighs approximately two times as much as non-absorber radome materials. As with any flying device, weight is a significant factor in the device's design.

One such RF absorbing ablating arrangement is shown in U.S. Pat. No. 4,748,449, issued on May 31, 1988, to J. Landers, Jr. et al. and assigned to the same assignee as that of the present invention. In addition, RF absorber material significantly reduces the azimuth beam width for continuous-slot antennas.

Further, the RF absorbing apparatus tends to distort the antenna pattern shapes due to the tolerances in the geometrical interfaces between the RF window and the RF absorber material. Further, the portion of the radome containing the RF absorber will ablate much differently than the portion of an unloaded (no absorber) radome. The RF absorber filled radome will tend to flow off of the missile. The unloaded radome material will actually ablate. Therefore, the radome surface becomes uneven which leads to reduced pattern stability.

Lastly, the use of an RF absorber material in a radome greatly increases the difficulty and cost of fabrication of the radome. The RF absorber material must be mixed or interfaced with the RF window material. This adds additional labor and cost.

Accordingly, it is an object of the present invention to provide for cancelling the mutual coupling between antennas of an antenna array without the use of RF absorbing apparatus.

It is a further object of the present invention to provide an environment which insulates a dielectric material from aerothermal environment.

SUMMARY OF THE INVENTION

In accomplishing the object of the present invention, a novel coupling cancellation arrangement and aerothermal protection arrangement for antenna arrays without the use of RF absorber material is shown.

An apparatus for cancellation of RF coupling between an array of antennas is shown. This apparatus includes a shroud. Receiving and transmitting antennas are each attached to the shroud axially along the shroud. The transmitting and receiving antennas are located in proximity to each other. As a result, a mutual RF coupling, which is undesirable, is present between the receiving and transmitting antennas.

A dielectric material is positioned across the axis of each of the receiving and transmitting antennas. The dielectric material induces further RF coupling between the receiving and transmitting antennas. However, this further coupling is approximately 180 degrees out of phase and equal amplitude with the mutual RF coupling. As a result, the couplings cancel each other and provide a high degree of isolation between the receiving and transmitting antennas as a result.

BRIEF DESCRIPTION OF THE DRAWINGS

FIG. 1 depicts a portion of a cross-section of a typical missile antenna assembly with a radome employing an RF absorber material.

FIG. 2 is an isometric view depicting an antenna waveguide of the long, continuous-slot variety.

FIG. 3 depicts a portion of a missile shroud showing the principles of operation of the present invention.

FIG. 4 is an embodiment of Applicant's invention depicting an aft antenna beam.

FIG. 5 depicts another embodiment of the present invention for a fore antenna beam.

DESCRIPTION OF THE PREFERRED EMBODIMENT

FIG. 1 is a cross-section of the antenna system for a typical missile. One-half of the cross-section is shown in FIG. 1. Long, continuous-slot antennas 1, 3, 5 and 7 comprise a portion of the fore antenna system. Antennas 2, 4 and 6 comprise a portion of the aft antenna system. Each of the antennas of a particular system is approximately 60 degrees with respect to the next antenna of that system. For example, fore antennas 3 and 5 are approximately 60 degrees apart. Further, aft antennas 2 and 4 are approximately 60 degrees apart. Sandwiched between each of the antennas is a layer of RF absorbing material. This configuration provides for coupling reduction between adjacent antennas. The above system of coupling reduction is essentially the one shown in U.S. Pat. No. 4,748,449, issued to the same assignee as the present application and mentioned above.

FIG. 2 is an isometric view of a long, continuous-slot antenna, such as those employed in FIG. 1. Antenna waveguide 25 is a hollow rectangular structure. Waveguide center line 26 is for reference only and does not form a functional part of the waveguide. Long, continuous-slot antenna 30 is a generally semi-circular slot cut in one surface of the antenna waveguide 25. This antenna is similar to the antenna shown and described in U.S. Pat. No. 4,328,502 which was mentioned above. This antenna is the kind employed in the preferred embodiment of the Applicant's invention. However, other shapes of antennas may equally well be employed.

FIG. 3 depicts missile shroud 40 including receive antenna 1 and transmit antenna 2 of a single antenna system. This is a simplified version of the antenna system but will suffice for purposes of explanation. Antenna 1 contains continuous-slot 21 and antenna 2 contains continuous-slot 22.

Shown, for example, are a few coupling paths A, B and C between transmit antenna 2 and receive antenna 1. There is nearly an infinite number of these transmission paths along each of the two slots 21 and 22. The coupling via paths A, B, and C causes mutual coupling and the inability to detect targets. A layer of dielectric material is applied circumferentially about the missile shroud 40. This dielectric material must be placed at the appropriate position covering a portion of the slotted antennas. The dielectric material provides a coupling path between receive antenna 1 and transmit antenna 2. This coupling path induces surface wave energy that is equal to and opposite in phase from the coupling of surface waves of other antennas including ambient coupling through the air. The induced coupling is 180 degrees out of phase with the signals normally coupled to receive antenna 1. Therefore, the induced coupling cancels the normal coupling and virtually eliminates all transient signals obtained by receive antenna 1.

The dielectric material placed across each of the antennas at a particular position will produce this coupling cancellation. The dielectric material is a low loss, high temperature material. The positioning of the dielectric material over the antenna array depends upon the antenna slot distribution, slot length, slot position with respect to physical boundaries of the antenna, antenna lean angle, antenna separation, radome thickness and operating frequency.

In the preferred embodiment of the present invention, the dielectric material is a dielectric film or polymide, marketed under the name KAPTON® by E. I. DuPont de Nemours. KAPTON® is a registered trademark of E. I. Dupont de Nemours. The particular implementation described herein was performed upon a long-slot antenna array mounted on approximately a 13 inch missile shroud. This antenna array has two sets of antennas to provide conical antenna patterns with different apex angles with respect to the missile axis. The antenna set with a smaller apex angle is called the fore beam antennas set. The set with a greater apex angle which forms a beam closer to the broad side is referred to as the aft beam. The transmit of each set antennas are separated from the receive antennas of that set by 60 degrees on the cylindrical plane as shown in FIG. 1.

FIG. 4 depicts the application of the dielectric film 60 (KAPTON)® film 4 mils thick and 6 inches wide across the antenna array including antennas 61, 62 and 63. Only a portion of the antenna array is shown for purposes of explanation. For the particular antenna system mentioned above, the KAPTON® film was located 10½ inches from the straight end of the antenna slot. The positioning of this dielectric film is critical to within 0.10 inch.

Once the dielectric film is applied as shown in FIG. 4, testing is performed on each antenna pair of the aft antenna beam. The initial testing of this arrangement was performed without a radome on a bare shroud without the dielectric film. Then the dielectric film was applied as indicated above and isolation measurements were again taken. The results appear below in Table 1.

TABLE 1

| Antenna Pair | Isolation, without Dielectric Film (dB) | Isolation, with Dielectric Film (dB) |
|---|---|---|
| A1-A2 | 81.0 | 87.5 |
| A3-A2 | 83.0 | >90.0 |
| A3-A4 | 85.0 | 89.5 |
| A5-A4[1] | 85.0 | 85.0 |
| A5-A6 | 84.0 | 88.5 |
| A1-A6 | 81.0 | >90.0 |
| Average | 83.2 | >88.4 |

[1]The A4 aft beam antenna stick had much larger discontinuities between itself and the ground plane than the other antenna sticks. This made the dielectric film optimization more difficult.

Antenna pairs (A1-A2 etc.), for example, refer to the coupling between aft antenna 1 (61) and aft antenna 2 (63) of the aft antenna array (not completely shown).

As can be seen from Table 1, several of the values were greater than 90 dB. The absolute magnitude cannot be determined since this was beyond the range of the measuring equipment. However, isolation above 90 dB is practically elimination of coupling. The variation in the isolation obtained with the dielectric film is due in part to the inaccuracy of its application as a horizontal ring as shown in FIG. 4. By adjusting the precise location of the dielectric film for each individual antenna pair, the isolation could be optimized to values greater than 90 dB.

The fore beam antenna isolation was maximized by the dielectric film (KAPTON)® film configuration shown in FIG. 5. This configuration included an application of dielectric film 70 over each of the antennas of the antenna array (not completely shown) including antenna 71, 72 and 73 as shown in FIG. 5. The dielectric film in this case was applied at a thickness of 2 mils. The positioning accuracy of the dielectric material in this configuration is to 0.01 inch.

The width of the dielectric film is approximately 2.7 inches. In addition, three strips 75 of a greater thickness of the dielectric material are applied over the basic 2 mils thickness of dielectric 70. Each of the three strips 75 are an addition 4 layers of 2 mils thickness per layer for a total of 10 mils thickness of dielectric material at each of the strips 75. The strips are each 0.50 inch in width. The spacing between strips and between the edges of the basic dielectric layer 70 and each strip 75 is 0.30 inch.

Again, the tested conditions were a radomeless bare shroud. Table 2 depicts the results of such testing both without the dielectric film and with the dielectric film.

TABLE 2

| Antenna Pair | Isolation, without Dielectric Film (dB) | Isolation, with Dielectric Film (dB) |
|---|---|---|
| F1-F2 | 76.5 | 88.0 |
| F3-F2 | 76.3 | >90.0 |
| F3-F4 | 73.5 | 82.5 |
| F5-F4 | 73.0 | 83.0 |
| F5-F6 | 75.0 | >90.0 |
| F1-F6 | 75.5 | 83.0 |
| Average | 75.0 | >86.1 |

Antenna pairs such as F1 and F2, etc. indicate coupling between 2 antennas of the fore antenna array (not completely shown). F1 corresponds to antenna 72 of FIG. 5 and F2 corresponds to an antenna not shown.

An improved coupling elimination arrangement has been shown. This coupling elimination arrangement does not use RF absorbing material which adds weight and cost to the missile.

Again, it is noted that making very small adjustments in the precise location of the dielectric film for each antenna pair, the isolation could be optimized to values greater than 90 dB.

In order to prevent the heat distortion (ablation) that occurs with rapidly flying objects such as missiles, a radome of QFELT® material may be included. QFELT® is a registered trademark of the Mansville Corporation. QFELT® material is manufactured by the Mansville Corporation and is used in high temperature applications such as the Space Shuttle. The application of a radome consisting of QFELT® material in combination with the above coupling elimination arrangement prevents coupling between antennas and protects dielectric film from the aerothermal environment ablation or distortion of the dielectric material which eliminates coupling. As a result, the flying missile will maintain its target detection capability throughout the flight.

An ablative radome may be used as well as the QFELT® radome. An ablative radome material such as TEFZEL® material (manufactured by DuPont) or ethylene tetrofluoroethylene may also be used. TEFZEL® is a registered trademark of E. I. Dupont de Nemours. However, these materials ablate instead of insulating like QFELT® material.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. Apparatus for cancellation of RF coupling between antennas of an array, said apparatus comprising:

shroud means having an axis;

receiving antenna means connected to said shroud means and said receiving antenna means having an axis;

transmitting antenna means connected to said shroud means and said transmitting antenna means having an axis, said axes of said shroud means, receiving antenna means and said transmitting antenna means being substantially parallel, said transmitting antenna means being located in proximity to said receiving antenna means whereby first RF coupling is present between said transmitting antenna means and said receiving antenna means; and dielectric means positioned across said axis of said receiving antenna means and said axis of said transmitting antenna means whereby second RF coupling is induced between said receiving and transmitting antenna means, said first and second RF couplings being approximately 180 degrees out of phase and substantially equal in magnitude substantially cancelling each other.

2. Apparatus for cancellation of RF coupling as claimed in claim 1, said dielectric means being further positioned across said axes of said receiving and transmitting antenna means at a predetermined distance from a first end of said receiving and transmitting antenna means.

3. Apparatus for cancellation of RD coupling as claimed in claim 1, said dielectric means including dielectric film means of a particular thickness.

4. Apparatus for cancellation of RF coupling as claimed in claim 3, said dielectric film means includes a polymide KAPTON® film.

5. Apparatus for cancellation of RF coupling as claimed in claim 1, each of said receiving antenna means and said transmitting antenna means including continuous-slot antenna means.

6. Apparatus for cancellation of RF coupling as claimed in claim 1, said apparatus further including:

said receiving antenna means including a plurality of receiving antenna device means, each receiving antenna device means being positioned so that said axis of said receiving antenna means is parallel to said axis of said shroud means;

transmitting antenna means including a plurality of transmitting antenna device means, each transmitting antenna device means being positioned regularly interleaved of said plurality of receiving antenna device means, said axis of said transmitting antenna device means being parallel to said axis of said shroud means and to said axis of said receiving antenna device means; and said dielectric film means including a continuous ring of dielectric film means placed across each of said axes of said receiving and transmitting antenna device means.

7. Apparatus for cancellation of RF coupling as claimed in claim 6, said plurality of receive antenna device means including a first fore beam antenna array means or a first aft beam antenna array means, said plurality of transmit antenna device means including a second fore beam antenna array means or a second aft beam antenna array means.

8. Apparatus for cancellation of RF coupling as claimed in claim 7, said continuous ring of dielectric film means including a plurality of raised thickness sections spaced at a particular distance from each other.

9. Apparatus for cancellation of RF coupling as claimed in claim 1, wherein there is further included ablative radome means positioned over said shroud means.

10. A method for cancellation of first RF coupling between receiving and transmitting antennas of an array mounted about the periphery of a shroud, said method comprising the steps of:

providing a dielectric material;

placing said dielectric material across an axis of said receiving antenna means and across an axis of said transmitting antenna means for inducing second RF coupling between said transmitting and receiving antenna means which is out of phase with said first RF coupling; and repositioning said dielectric material with respect to said axes of said receiving and transmitting antenna means so that said first and second RF coupling are approximately 180 degrees out of phase and substantially equal in magnitude substantially cancelling each other.

11. The method as claimed in claim 10, wherein there is further included the steps of:

measuring with a spectrum analyzer the amount of RF coupling between said transmitting antenna means and said receiving antenna means; and adjusting said position of said dielectric material so that said spectrum analyzer indicates RF coupling cancellation of said first and second RF couplings.

12. The method as claimed in claim 11, wherein there is further included the steps of:

providing a plurality of transmit antenna device means; and providing a plurality of receive antenna device means.

13. The method as claimed in claim 12, wherein there is further included the steps of:

providing a dielectric film;

applying said dielectric film across said axes of each of said plurality of receive and transmit antenna device means; and adjusting the position of said dielectric film so that the measured amount of said first RF coupling is substantially cancelled.

14. The method as claimed in claim 13, wherein said step of providing said dielectric film includes the step of providing a dielectric film with sections of a first particular thickness regularly spaced from sections of a second particular thickness of said dielectric film.

15. In a missile system including a missile, apparatus for cancellation of RF coupling between an array of antennas for controlling detonation of said missile, said apparatus comprising:

shroud means having an axis;

receiving antenna means connected to said shroud means and said receiving antenna means having an axis;

transmitting antenna means connected to said shroud means and said transmitting antenna means having an axis, said axes of said shroud means, said receiving antenna means and said transmitting antenna means being substantially parallel, said transmitting antenna means being located in proximity to said receiving antenna means whereby first RF coupling is present between said transmitting and receiving means;

dielectric means positioned across said axis of said receiving and said axis of said transmitting antenna means whereby second RF coupling is induced between said receiving and transmitting antenna means, said first and second RF couplings being approximately 180 degrees out of phase and substantially equal in magnitude substantially cancelling each other; and radome means encircling said shroud and said receiving and transmitting antenna means, said radome means for protecting said dielectric means from heat during high velocity flight of said missile, said radome means comprising QFELT® material.

16. Apparatus for cancellation of RF coupling as claimed in claim 15, said, dielectric means being further positioned across said axes of said receiving and transmitting antenna means at a predetermined distance from first end of said receiving and transmitting antenna means.

17. Apparatus for cancellation of RF coupling as claimed in claim 15, said dielectric means including dielectric film means of a particular thickness.

18. Apparatus for cancellation of RF coupling as claimed in claim 17, said dielectric film means includes a polymide KAPTON® film.

19. Apparatus for cancellation of RF coupling as claimed in claim 15, each of said receiving antenna means and said transmitting antenna means including continuous-slot antenna means.

20. Apparatus for cancellation of RF coupling as claimed in claim 15, said apparatus further including:

said receiving antenna means including a plurality of receiving antenna device means, each receiving antenna device means being positioned so that said axis of said receiving antenna means is parallel to said axis of said shroud means;

transmitting antenna means including a plurality of transmitting antenna device means, each transmitting antenna device means being positioned regularly interleaved of said plurality of receiving antenna device means, said axis of said transmitting antenna device means being parallel to said axis of said shroud means and to said axis of said receiving antenna device means; and said dielectric film means including a continuous ring of dielectric film means placed across each of said axes of said receiving and transmitting antenna device means.

21. Apparatus for cancellation of RF coupling as claimed in claim 20, said plurality of receive antenna device means including a first fore beam antenna array means or a first aft beam antenna array means, said plurality of transmit antenna device means including a second fore beam antenna array means or a second aft beam antenna array means.

22. Apparatus for cancellation of RF coupling as claimed in claim 21, said continuous ring of dielectric film means including a plurality of raised thickness sections at a particular distance from each other.

* * * * *

UNITED STATES PATENT AND TRADEMARK OFFICE

CERTIFICATE OF CORRECTION

PATENT NO. : 5,047,787

DATED : September 10, 1991

INVENTOR(S) : Shawn W. Hogberg

It is certified that error appears in the above-identified patent and that said Letters Patent is hereby corrected as shown below:

In column 6, claim 3, line 20, replace "RD" with --RF--.

Signed and Sealed this

Fourth Day of May, 1993

*Attest:*

Michael K. Kirk

MICHAEL K. KIRK

*Attesting Officer*

*Acting Commissioner of Patents and Trademarks*